US006091890A

United States Patent [19]

Gruzdev et al.

[11] Patent Number: 6,091,890

[45] Date of Patent: Jul. 18, 2000

[54] METHOD AND APPARATUS FOR HEAT GENERATION

[76] Inventors: Valentin A. Gruzdev, 103460, Moscow, Block 1126, Apt. 309, Moscow, Russian Federation; Pavel V. Efremkin, 39 Larchmont St., Ardsley, N.Y. 10502

[21] Appl. No.: 09/108,589

[22] Filed: Jul. 1, 1998

[30] Foreign Application Priority Data

Jul. 9, 1997 [RU] Russian Federation ..... 97111474

[51] Int. Cl.[7] ..... F24H 1/10

[52] U.S. Cl. ..... 392/485; 432/219; 432/29

[58] Field of Search ..... 392/465, 466, 392/483, 485, 311, 312; 250/428–431; 126/344–45, 373, 380, 387, 263.01, 247, 255; 376/100, 111, 156; 44/301, 302; 204/660; 432/219, 29

[56] References Cited

U.S. PATENT DOCUMENTS

| | | | |
|---|---|---|---|
| 5,188,090 | 2/1993 | Griggs | 126/247 |
| 5,559,924 | 9/1996 | Kadotani et al. | 392/483 |
| 5,784,531 | 7/1998 | Mann et al. | 392/494 |
| 5,800,576 | 9/1998 | Johnson et al. | 44/301 |

FOREIGN PATENT DOCUMENTS

| | | | |
|---|---|---|---|
| 2054604 | 2/1996 | Russian Federation | F24J 3/00 |
| 2061195 | 5/1996 | Russian Federation | F24J 3/00 |
| 90/00526 | 1/1990 | WIPO | C02F 1/48 |

*Primary Examiner*—Teresa Walberg
*Assistant Examiner*—Thor S. Campbell
*Attorney, Agent, or Firm*—Lawrence G. Fridman

[57] ABSTRACT

An apparatus for heat generation includes a vessel having a working chamber formed within an interior thereof. The working chamber contains a working polar fluid. A source of pulsed light and a light-reflecting surface wettable by the working fluid are situated within the working chamber. A thermal energy is released into the working polar fluid by the pulsed light irradiation of the working fluid in the vicinity of the light-reflecting surface.

12 Claims, 1 Drawing Sheet

METHOD AND APPARATUS FOR HEAT GENERATION

FIELD OF THE INVENTION

The present invention relates to heat and power engineering and, more particularly, to a method and an apparatus for heating of fluids.

BACKGROUND OF THE INVENTION

There is known a method and apparatus for heat generation in the fluid, based on conversion of the kinetic energy of the flowing fluid into heat, as disclosed by U.S. Pat. No. 5,188,090 to Griggs.

This apparatus consists of an apparatus for forming a high-speed fluid jet and moderation thereof. The process of moderation is adapted for conversion of the jet kinetic energy into the heat energy accompanied by the fluid temperature increase.

Drawbacks of such known method and apparatus reside in the low values of the conversion of the energy delivered to a pump drive into the thermal energy of the fluid. In view of the pure mechanical nature of the used conversion principles, these values are not very high. The principles of this project are indifferent to physicochemical properties of the fluid used.

Another example of a method for generating energy is described in Russian Patent No. 2,054,604 issued Feb. 20, 1996. This method is based on the exposure of a fluid to the action of a combination of constant and alternating pressures, in certain ratios, leading to formation of cavitation bubbles in the fluid. Upon bursting, these bubbles convert their internal energy into the thermal energy of the fluid.

An apparatus for carrying out this method employs an ultrasonically-induced cavitator to exert alternating pressure.

These method and apparatus are similar to the above discussed and are applicable with different working fluids. It has been shown experimentally that the amount of the liberated thermal energy exceeds that of the initial energy delivered. This is explained by the fact that the heat energy release in the fluid depends on the course of nuclear reactions.

As a consequence, in accordance with the disclosure of this patent, the heat generation is accompanied by the ionizing radiation, specifically the neutron radiation, which significantly exceeds in quantity the level of natural radiation. Therefore, use of such method and apparatus is not environmentally safe. Moreover, the use of cavitation should often result in the destruction of the used apparatus.

There is also known a method of heat generation in the fluid disclosed by Russian Patent No. 2,061,195 issued May 27, 1996. This method is also based on the use of cavitation and is directed to increase the intensity of cavitation by forming a gas cushion in a fluid. Such cushion cavitates in a closed-loop system and by varying the volume of the gas cushion and varying fluid flow rate until self-excited conditions are established. An apparatus for carrying out this method comprises a hydraulic closed-loop system with an expanding container, a piston movable within the container, a centrifugal cavitator and a heat exchanger for supplying heat to a customer.

Important advantages of these method and apparatus are in the fact that the increase in heat generation results from improving intensity of the cavitation processes and is accompanied by the reduction of negative consequences of the cavitation on the operational life span of the structural elements of the apparatus. This is due to the fact that gas bubbles or cavities are formed mostly inside the fluid.

In view of the common physical principles utilized by Russian Patent No. 2,061,195 and the foregoing technical solutions, a possibility exists for creation of a system with high efficiency conversion of the delivered energy into a thermal energy of the fluid. However, in view of the above discussed common principles, the method and apparatus disclosed by Russian Patent No. 2,061,195 suffer from a substantial drawback. That is, environmental safety of its operation cannot be assured.

Furthermore, there is known a method described in the International application PCT WO 90/00526 (1990) consisting of formation of oppositely directed vortex streams of deionized water and causing such streams to collide at a high rate of flow. As indicated by the disclosure of this International application, the disagglomeration of water (which is the main object of the method), is accompanied by heating of water. Such heating is additional to the heat generation achieved as a result of conversion of the kinetic energy of flowing water.

An apparatus for carrying out the method disclosed in this PCT application consists of a colloidal mill containing a tank with oppositely positioned vortex nozzles included in a closed-loop system. The apparatus also contains a pumping arrangement and a heat exchanger for absorption of heat liberated in the fluid.

In the method and apparatus disclosed by PCT WO 90/00526, it is essential to use the unique properties of water causing energy release as a consequence of the breaking of hydrogen bonds. The necessity of employing the water as a working fluid restricts the scope of possible applications of such method and apparatus for the purposes of heat generation. Moreover, it is indicated in the disclosure of the International application PCT WO 90/00526 that, the heat energy generation is accompanied by the release of electrical energy. Since the latter takes place, apparently, through electromagnetic radiation, the environmental safety of these technical solutions is also questionable.

All technical solutions discussed hereinabove suffer from a common drawback residing in the fact that heat generation is associated with a preliminary conversion of the delivered energy into the kinetic energy of the fluid (see for example PCT application WO 90/00526). This leads to a considerable complexity of delivery of a heat-transfer fluid from a place of acquiring energy to a consumer.

SUMMARY OF THE INVENTION

It is, therefore, an object of the invention to provide a method and apparatus for heat generation.

A further object of the invention is to provide a method and apparatus for heat generation which are environmentally safe.

It is also an object of the invention to minimize the preliminary conversion of the delivered energy into the kinetic energy of the working fluid.

It is a further object of the invention to provide a method and apparatus capable of expanding the wide range of the used fluids.

In the method and apparatus of the present invention, a polar liquid is used as the working fluid. The polar working fluid is irradiated by a pulsed light radiation in a zone of contact or engagement between the working fluid and a light-reflecting screen or surface situated within the fluid.

The screen or surface is made of a material wettable by the working fluid or formed with a coating made of such material.

Such combination of properties of the screen and the working fluid assures presence of immobile or slow-moving molecules in the vicinity of the screen. The light-reflecting properties of the screen enhance usage of the light radiation energy for separation of the immobile or slow moving molecules from the surface of the screen. The slow-moving molecules separated from the screen surface receive energy liberated in the formation of molecular clusters. Development of such clusters, in cases of spontaneous collisions of the molecules of the working fluid having greater mobility (or formations originated earlier) is caused by the polar properties attributable to the working fluid.

To increase the intensity of heat generation the working fluid can be irradiated by the pulsed light radiation generated by an extended source of such radiation.

In order to increase the total volume of the working fluid to be heated and also to enhance the usage of the generated heat, a part of the heated working fluid is removed from a zone of action by the pulsed light radiation, cooled and then returned back into this zone.

An apparatus for heat generation of the present invention, comprises a vessel or container with means assuring results of the pulsed optical radiation on the working fluid. To achieve the above-mentioned technical results in the apparatus of the present invention, the container or vessel is filled with a polar working fluid. A light-reflecting screen or surface made of a material wettable by the working fluid or having a coating of this material is positioned within the polar working fluid. A source of pulsed optical radiation is provided to irradiate the working fluid in the zone of it's contact with the surface of the light-reflecting screen located in the fluid.

As a result of the pulsed light radiation, the apparatus of the invention is not only capable of separation of the immobile molecules of the working fluid from the surface of the light-reflecting screen, but it can also replenish mobile molecules of the working fluid.

To achieve simultaneous irradiation of a large volume of the working fluid, the source of pulsed light radiation can be extended through the working chamber.

In order to improve intensity of action on the working fluid, the light-reflecting screen or surface situated within the fluid can be formed as a wall of the working chamber embracing the extended source of pulsed light radiation. The working chamber communicates with part of the system situated outside of the vessel or container. This enables the invention to replace the working fluid situated in the space between the source of pulsed optical radiation, and the light-reflecting screen by the fluid from the space external to the light-reflecting screen.

A wall or interior of the working chamber embracing the extended source of pulsed optical radiation forming the light-reflecting screen can be made of two or more similar parts located symmetrically about a longitudinal axis of the extended source. In this respect, adjoining parts of the chamber wall are curved toward each other so as to form between its edges slots resembling in a cross section thereof a contracting nozzle profile. The above discussed replacement of the working fluid can be accomplished through these slots. Portions of the interior of the working chamber wall forming the light-reflecting screen contain a developed mirror surface. This results in the increase of the total number of molecules of the working fluid simultaneously affected by the pulsed optical radiation, leading to more efficient utilization of the radiation energy.

BRIEF DESCRIPTION OF THE DRAWINGS

The various objects, advantages and novel features of the present invention will be more readily apparent from the following detailed description when read in conjunction with the appended drawings, in which.

DETAILED DESCRIPTION OF THE PREFERRED EMBODIMENTS

Figure 1:
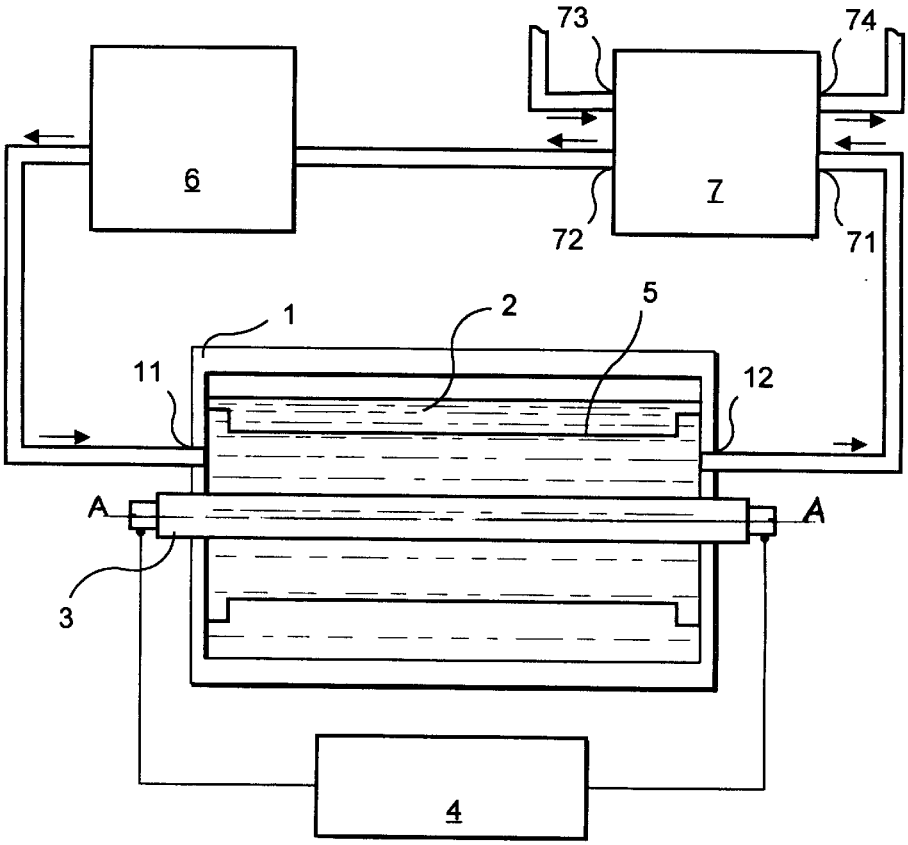
FIG. 1 illustrates a cross-sectional view of an apparatus for heat generation, of the present invention.

Referring to FIG. 1, an apparatus of the invention is formed by a container or vessel 1 having a working chamber filled with a working polar fluid 2. A source of pulsed light or pulsed light radiation 3 is located within the working fluid. In the embodiment shown in FIG. 1, a flash lamp or a high power gas-discharge tube is utilized as the source of pulsed light radiation. The flash lamp 3 extends longitudinally within the container also including a light reflecting screen or surface 5 which substantially surrounds the flash lamp. In the embodiment of FIG. 1 the longitudinal dimensions of the flash lamp 3 at least ten times exceed the transverse dimensions thereof. The flash lamp 3 is connected to a source of pulse voltage 4. Although a specific source of pulsed light or pulsed light radiation has been described, it should be understood that any source of pulsed light or light radiation is within the scope of the invention.

The container or vessel 1 is formed with an inlet port 11 and an outlet port 12, adapted for connection of the vessel to a pumping arrangement 6 and a heat exchanger 7, so as to define a closed-loop or semiclosed-loop system for the working fluid. The heat exchanger 7 includes an inlet port 71 and an outlet port 72 also forming a part of the system. The working fluid is fed into the working chamber through an inlet port 73 of the heat exchanger and is removed from the working chamber of the system and supplied to a consumer through an exit port 74 of the heat exchanger. The pumping arrangement 6 is provided with a conventional or an electric drive (not shown in FIG. 1).

Figure 2:
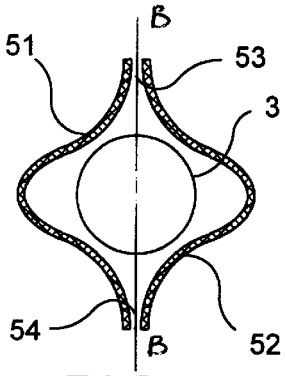
FIG. 2 illustrates an embodiment of a light-reflecting screen formed as a wall of a chamber and composed of two parts.
Figure 3:
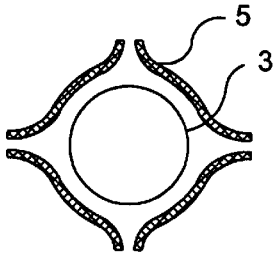
FIG. 3 illustrates an embodiment of the light-reflecting screen composed of four parts.

Referring now to FIG. 2 which is a sectional view further illustrating the light-reflecting surface or screen 5 and the flash lamp 3. The light-reflecting surface or screen 5 is formed by an inner wall of the working chamber embracing the flash lamp 3. In the embodiment of FIG. 2, the screen 5 is made of two substantially similar parts 51 and 52 situated symmetrically about a longitudinal axis A—A of the flash lamp 3. The parts 51 and 52 are also symmetrical about a plane passing through a vertical axis B—B of FIG. 2. The inner areas of the parts 51 and 52 of the screen facing the flash lamps are formed with developed mirror surfaces. Such mirror surfaces can be formed having a corrugated or saw-toothed configuration. As illustrated in FIG. 2, the first 51 and second 52 parts of the chamber wall forming the light-reflecting surface or screen 5 can be fairly curved towards each other so as to form between edges thereof slots 53 and 54 having a cross section resembling a contracting nozzle profile. FIG. 3 illustrates an embodiment of the light-reflecting surface or screen 5 composed of four substantially similar parts.

Figure 4:
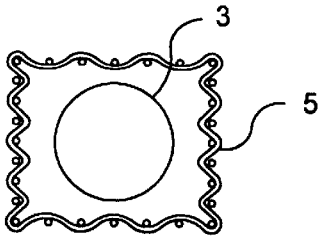
FIG. 4 illustrates another embodiment of the light-reflecting screen, made of a grid forming in cross section a closed loop in the form of a rectangle.
Figure 5:
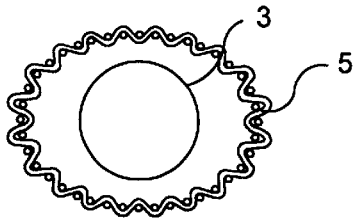
FIG. 5 illustrates an embodiment of the invention similar to that of FIG. 4 with the closed loop having an elliptical configuration.

As depicted in FIGS. 4 and 5, the light-reflecting screen 5, can be formed as a wall of a chamber completely surrounding the flash lamp 3. In this embodiment the wall of the chamber is made as a net or grid from a material having a mirror-like surface. The cross section of the chamber may resemble a rectangle or ellipse.

The working fluid utilized by the invention is a polar fluid or polar dialectric having molecules formed as elementary electrical diapoles. The polar dialectrics are also known as a dialectrics with molecules (atoms) positioned asymmetrically relative to their nucleus. The container 1 is filled with a polar liquid capable of wetting the surface of the light-reflecting screen 5. In the case of a silver or silver-plated screen such conditions are satisfied by utilizing such working polar fluids as water, alcohol and a number of other liquids. In all embodiments of the light-reflecting screen of the invention, the apparatus of the invention operates in a similar manner and depends on the following physical phenomena and properties of polar liquids.

It is known that the liquid phase of water contains varying aggregates of molecules or clusters [see, Clifford E. Swartz, Unusual Physics of Usual Phenomena, Moscow, Science Publishing, 1986]. The emergence of clusters is caused by the polar properties of water. In view of these properties separate molecules and groups of molecules come into electrical interaction making the presence of clusters inherent in to many polar liquids.

Clusters are continuously composed and breaking apart. The formation of the clusters is accompanied by energy release. In the present invention, the rate of cluster formation often exceeds the rate of their breaking. As a result of a non-elastic collision of two constituents, either individual molecules and/or clusters developed earlier, formation of new clusters takes place in the presence of a third particle in the collision zone. The rate of cluster formation is determined by the concentration of such third particles. The probability of triple collisions is the greatest when the third particles are slow-moving ones. Such slow-moving particles are those just vacated the surface of the screen positioned within the working fluid and still situated in the proximity of the surface of the screen. Fluid molecules situated in the vicinity of the screen surface are affected by the cohesive forces (i.e., forces directed from other molecules of the working fluid) and adhesive forces (i.e., the forces of interaction with a screen material). The cohesive and adhesive forces usually act in opposite directions. This is specifically so in the case of working fluid capable of wetting the screen surface. The wetting further provides constant presence of the molecules of the working fluid on the screen surface. As a result of minor forces exerted on such molecules and their losing contacts with the screen surface, these molecules are ready and capable of passing to a free state.

In the embodiment of the apparatus depicted in FIG. 1, formation of clusters occurs in the vicinity of the surface of the screen and takes place upon action of the pulsed light radiation generated by the flash lamp 3 on the working fluid 2. To increase the effectiveness of this action by the pulsed light radiation, the surface of the screen 5 is made from light-reflecting material and/or formed with a mirror-type coating. The molecules of working fluid lose contact with the surface of the light-reflecting screen 5 under the action of quanta of light radiation. Quantity of the released molecules depends on the material of the light-reflecting screen 5. Specifically, such quantity depends upon the properties which define the magnitude of adhesive forces for the molecules of a specific working fluid. For example, in the case of a silver or silver-plated screen and water used as the working fluid, the magnitudes of adhesive and cohesive forces are substantially balanced. Therefore, the process of releasing the molecules from the surface of the screen occurs under lower energy of the light pulse. The released molecules facilitate development of molecular formations. A new molecular formation operates in an excited state and, after multiple collisions, transfers own oscillatory energy to other molecules of the working fluid. Energy liberated in the course of formation-development is adapted by the molecule released from the surface of the light-reflecting screen 5 and present in the collision zone. As a result of such collisions, this energy is transferred to other molecules. Upon the action of the light pulse, a certain quantity of working fluid or water leaves the area in the vicinity of the light-reflecting screen 5. This portion of working fluid or water is replaced by a new portion of working fluid or water from a chamber space surrounding the flash lamp 3 having a wall formed as the light-reflecting screen 5. Hereinafter, this process is repeated over and over.

When the working fluid 2 is stationery, its temperature rises to reach a heat balance with the surrounding environment. Such balance is reachable if it is possible, under specific conditions, to transfer heat to the surroundings. Otherwise, a further elevation of the working fluid temperature occurs and, upon transition of a part of fluid to a gaseous phase, operation of the apparatus is interrupted.

The loss of contact between the molecules of liquid and the surface of the screen takes place as a result of irradiation of the polar working liquid by the pulsed light radiation in the area of contact between the liquid and the screen. The released molecules of liquid enable the invention to form the clusters of molecules. This Process is accompanied by an additional release of heat or thermal energy into the liquid.

The energy in the range of $10^{-20}$ J and the density of the optical radiation energy on the screen of no less then 1 J/m$^2$ is necessary for the removal of the molecules of liquid from the surface of the screen. Such density can be provided by, for example, a source of pulsed light radiation having the energy 100 J with the duration of impulse $10^{-2}$ sec and power $10^6$ W. Within certain time after separation of the molecules from the wetted screen a layer of the particles of liquid capable of repeating the process is formed on the screen. Such process can be continued until it is possible to form clusters of the molecules within the liquid. Upon reaching a saturation point it is recommended to replace the working liquid. For maximizing the release of the energy, the initial quantity of the clusters of molecules in the working liquid should be minimal.

To efficiently participate in the triple collision and particle formation process the time of removal of the molecules of the working fluid from the light-reflecting screen should be minimized. In the invention, this is achieved by utilizing the sources of pulsed light radiation generating pulses of the light radiation having limited duration.

When the pumping means 6 is in use and heat is removed from of the heated working fluid in the heat exchanger 7 (for example, of a recuperative type), a heat balance is achieved at a lower temperature of the working fluid in the vessel 1.

In the invention, operation of the apparatus with the high efficiency release of thermal energy (relative to the quantity of the overall initially delivered energy necessary for running the process of heat generation) takes place until a change in the properties of the working fluid circulated within the hydraulic closed-loop system occurs. As a result of such changes, the ability to form clusters with the release of energy is terminated. At this point the working fluid should be replaced.

The invention represents an arrangement for the conversion of the potential energy of the working fluid into the kinetic energy of its molecules resulting in the temperature elevation of the working fluid. The quantity of potential energy converted into the kinetic energy is defined by the concentration of clusters or free molecules capable of participating in the formation process.

The apparatus of the present invention can also form a part of a hydraulic semiclosed-loop system having in addition to the above discussed elements, a separating arrangement or a liquid separator. The main function of the liquid separator (not shown) is to separate a processed working polar liquid from the working polar liquid before the process of irradiation by the pulsed light. During this process, the clusters of molecules or formations are separated. The stream of such clusters is directed to the area of the chamber having the most favorable conditions for the formation process. Then, the processed working liquid is removed from the circuit and is replaced by the fresh working liquid. The operation of the separating arrangement can be based on electrostatic, magnetic, electromagnetic, and hydraulic principles.

In the experimental studies of the method and apparatus of the present invention, water was used as a working fluid. The thermal energy was generated within a wide range of pulses light radiation. The duration of the pulse was within the range of 1–5.10 microsec. with the pulse recurrence of frequency from 0.01 to 100 Hz. Industrial flash gaseous discharge lamps of visible light radiation spectrum were used as the sources of pulsed lights radiation. In order to generate the thermal energy exceeding in quantity the energy consumed during the process (with a limited amount of the consumed energy) it is necessary to experimentally select the power of the source of light radiation. The selection depends on specific structural parameters of the apparatus and operating conditions thereof, such as: the volume of the working fluid in the vessel; configuration and dimensions of the flash lamp; the distance from the flash lamp to the light-reflecting screen, the fluid circulation rate; cooling conditions; etc. In the conducted experiments the light radiation density in the range of $10^{-4}$–1 J/mm$^2$ at the light-reflecting screen corresponded to the required radiation power.

The Table presented hereinbelow contains results of the experiments illustrating generation of the thermal energy in the apparatus of the invention.

The molecules of liquid in the excited condition are developed in a part of the working liquid removed from the circuit. It is expected that the working liquid removed from the circuit should have a high level of biological activity and should favorably affect the cells of live organisms. Seeds of vegetables and nursery flowers were used during investigation of the biological activity of the working polar liquid removed from the circuit of the invention. The seeds were separated into two groups. Ordinary water was applied to the first group, whereas the working water removed from the apparatus of the invention was utilized in the second group. According to this experiment, the rate of growth of seeds treated by the water removed from the circuit was 1.5–2 times greater compared to the seeds treated by the ordinary water. The nursery flowers treated by the water from the circuit bloomed significantly earlier than the nursery flowers treated by the ordinary water. It is expected that water from the circuit should favorably affect human skin and can be used for treatment of dermatological diseases.

The invention in its broader aspects is not limited to the specific details, and various changes and modifications obvious to one skilled in the art to which the invention pertains are deemed to be within the spirit, scope and contemplation of the invention as further defined in the appended claims.

TABLE

| | Pulse duration micro-sec | Pulse recurrence frequency, Hz | Optical radiation energy in the pulse over the entire screen surface, J | Consumed to generated heat energy conversion ratio |
|---|---|---|---|---|
| 1 | 300 | 0.05 | 25 | 1.0 |
| 2 | 300 | 0.05 | 200 | 1.5 |
| 3 | 300 | 0.01 | 100 | 1.0 |
| 4 | 300 | 0.1 | 100 | 1.5 |

What is claimed is:

1. An apparatus for heat generation, comprising:

a vessel, said vessel having a working chamber formed within an interior thereof;

said working chamber containing a working polar fluid;

a source of pulsed light within said working chamber;

a light-reflecting surface wettable by said working fluid within the working chamber;

whereby a thermal energy is released into said working polar fluid by pulsed light irradiation of said working fluid in the vicinity of said light-reflecting surface.

2. The apparatus of claim 1, wherein said source of pulsed light extends longitudinally within said working chamber and said light-reflecting surface forms at least a portion of said interior of the vessel substantially surrounding said source.

3. The apparatus of claim 2, wherein said light-reflecting surface is formed by at least two substantially similar parts having mirror-type surfaces and located substantially symmetrically about a longitudinal axis of said source, portions of said at least two substantially similar parts adjacent each other are curved and spaced from each other, so as to form a space for removal of said working polar fluid.

4. The apparatus of claim 3, wherein said light-reflecting surface is formed by four substantially similar parts.

5. The apparatus of claim 2, wherein said light-reflecting surface forming at least a portion of said interior of the vessel is developed as a net having a mirror-type exterior, said net having a closed loop cross-sectional configuration.

6. The apparatus of claim 2, wherein said vessel further comprises a hydraulic closed-loop system having a piping arrangement and a heat exchanger.

7. The apparatus of claim 2, wherein said vessel further comprises a hydraulic semiclosed-loop system having a heat exchanger and a separating arrangement for separation of a processed polar fluid from said working polar fluid before said irradiation of the working fluid by said pulsed light, whereby said separating arrangement can be selected from the group consisting an electrostatic separating arrangement, a magnetic separating arrangement, an electromagnetic separating arrangement and a hydraulic separating arrangement.

8. A method of heat generation in an apparatus comprising, a vessel having an interior forming a working chamber, a working polar fluid within said working chamber, a source of pulsed light within said working chamber, a light-reflecting surface with at least a part of its exterior wettable by said working fluid, said surface situated within the working chamber, said method comprising the steps of:

(a) irradiating said working polar fluid in the vicinity of said light-reflecting surface by a pulsed light generated by a source of said pulsed light situated within the working polar fluid; and (b) heating said polar working fluid by energy generated during said irradiation and released into said polar working fluid.

9. The method of claim 8, further comprising the steps of:

(c) removing said heated working fluid from a zone of action by said pulsed light; and (d) returning said working fluid into said zone of action by said pulsed light.

10. The method of claim 8, wherein in said steps (a) and (b) an energy of said pulsed light is selected in such a manner that said energy of said pulsed light per one molecule of the polar fluid at the light-reflecting surface is greater than an energy of connection between said molecule and said light-reflecting surface, with duration of an impulse of said light irradiation not exceeding $10^{-2}$ SEC.

11. A method of heat generation within a working polar fluid by at least partial conversion of an internal energy of fluid into a thermal energy thereof, said method comprising the steps of:

(a) irradiating a polar working fluid by a pulsed light in a vicinity of a contact between said polar working fluid and a light-reflecting screen having at least a part of its exterior wettable by said working fluid;

(b) heating said working polar fluid as a result of said irradiation.

12. The method of claim 10, wherein said pulsed light deliveries energy capable of changing a potential energy of at least molecular formations of said polar working fluid.

* * * * *